United States Patent [19]

Mattheis et al.

[11] Patent Number: 4,485,862

[45] Date of Patent: Dec. 4, 1984

[54] PENCIL SHARPENER

[75] Inventors: Harley H. Mattheis, Verona; Agha M. A. Khan, Jersey City, both of N.J.

[73] Assignee: Risdon Corporation, Naugatuck, Conn.

[21] Appl. No.: 413,997

[22] Filed: Sep. 2, 1982

[51] Int. Cl.[3] ..... B43L 23/00

[52] U.S. Cl. ..... 145/3.1; 145/3.31; 145/3.61

[58] Field of Search ..... 145/3.1, 3.31, 3.5, 145/3.6, 3.61

[56] References Cited

U.S. PATENT DOCUMENTS

| | | | |
|---|---|---|---|
| 496,128 | 4/1893 | Moore | 145/3.31 |
| 653,720 | 7/1900 | Weitzel | 145/3.31 |
| 942,107 | 12/1909 | Rydquist | 145/3.31 |
| 2,122,386 | 6/1938 | Wells | 145/3.31 |

FOREIGN PATENT DOCUMENTS

| | | | |
|---|---|---|---|
| 64917 | 10/1892 | Fed. Rep. of Germany | 145/3.31 |

*Primary Examiner*—Frederick R. Schmidt
*Assistant Examiner*—J. T. Zatarga
*Attorney, Agent, or Firm*—St. Onge, Steward, Johnston & Reens

[57] ABSTRACT

Disclosed is a pencil sharpener adapted to sharpen pencils of a plurality of different sizes and to a method for making such a sharpener. The simplicity and convenience afforded by the sharpener enable the provision of an elegant outer appearance, especially suitable for cosmetic pencil use. The pencil sharpener (10) comprises a point cutting assembly (20) having a cylindrical pencil guide (21), a nestable first sleeve (30) having a smaller interior opening (32), and a second adaptor sleeve (40) having a yet smaller interior opening (42). The adaptor sleeves can be held by adaptor holding means comprising a projection (28) within the cuttings holder means (50) when not in use.

5 Claims, 5 Drawing Figures

PENCIL SHARPENER

DISCLOSURE

1. Technical Field

The present invention relates to pencil sharpeners; and, more particularly to devices of this type which are adaptable for use with pencils of a plurality of different diameters, and to a method for making sharpeners of this type.

Desk-mounted pencil sharpeners having a number of differently-sized pencil guides that can be easily moved into position to adapt to pencils of different sizes are available. However, there has not been a similar portable device available which could adapt to at least three differently-sized pencils. Moreover, no portable device is known which could maintain even a single extra adaptor for a differently-sized pencil together as a unit with the sharpener when the adaptor is not in use.

The need for a compact unit of the type described which is adaptable to use with a variety of differently sized pencils and can neatly contain both the cuttings resulting from sharpening and the adaptors awaiting use, is particularly needed for use with cosmetic pencils. Typically, women will have cosmetic pencils in a plurality of different diameters contained within a purse or cosmetic kit. It would be desirable to be able to sharpen pencils of this type with a single unit and without the need for immediately disposing of the cuttings.

2. Background Art

The prior art has provided portable pencil sharpeners adaptable to sharpen pencils of two different sizes. For example, in U.S. Pat. No. 4,248,283 to Kaye, FIG. 7 shows a cosmetic pencil sharpener having a sharpener unit with two separate bores encased within a two-piece chip collector. While this device is obviously functional for its intended purpose, the requirement that a separate hole be provided for each pencil of different diameter undesirably adds to the bulk of the unit. And, the provision of a separate sharpener base for each differently-sized pencil impairs the aesthetics of the device in terms of size, shape and overall appearance.

One device which is currently available appears outwardly to be much like the main body unit of the Kaye device as shown in FIG. 1, but has a removable sleeve which fits within the pencil guiding bore to adapt it to use for pencils of two different diameters. While no patent or printed publication is known describing this device, there is indication on the device that it was made in West Germany under the trademark KUM. Photographs of this device are enclosed in the file of this application. While this device does dispense with the need for a second separate bore by the provision of an adaptor, it is limited to use with pencils of two sizes, it does not provide for collecting cuttings, and the removable sleeve can be easily misplaced when removed for sharpening a pencil of the larger diameter. Several older patents also show the use of removable sleeves for adapting table-top sharpeners to pencils of different diameters. Representative of these are U.S. Pat. No. 419,307 to Bigham and U.S. Pat. No. 2,615,426 to Fryer.

There remains a need for a portable pencil sharpener adapted to sharpen pencils of a plurality of sizes which is constructed to provide a high degree of convenience, but yet provide an aesthetically pleasing exterior design consistent with the elegance normally associated with cosmetic products. Further, there remains a need for a method of making a pencil sharpener of this type in an economical manner.

DISCLOSURE OF INVENTION

The present invention provides a pencil sharpener adapted to sharpen pencils of a plurality of different sizes and also provides a method for making such a pencil sharpener, particularly sharpeners of this type intended for use with cosmetic pencils.

According to one aspect of the invention, the pencil sharpener comprises: a point-cutting assembly comprising cutting means and a pencil guide adapted to axially position a pencil for cutting by the cutting means; a first adaptor sleeve having an inside diameter smaller than that of the pencil guide and an outside configuration operative to releasably engage the inner surface of the guide; and a second adaptor sleeve having an inside diameter smaller than that of the first adaptor sleeve and an outside configuration operative to releasably engage the inner surface of the first adaptor sleeve.

According to another aspect of the invention, the sharpener can include one or more adaptor sleeves and will comprise adaptor holding means for holding one or more sleeves when not in position for use. According to one arrangement, the adaptor holding means comprises a projection positioned on the end of the cutting assembly which is opposite to the pencil guide. By virtue of this arrangement, one or more adaptors can be conveniently nested and held by the adaptor holding means when not in use. According to another embodiment, the adaptor holding means can comprise a tube closed at one end positioned over the cutting means to not only maintain the adaptor sleeves with the pencil sharpener to prevent their loss, but to conveniently hold cuttings and provide a highly-attractive exterior appearance.

The method in one of its broad aspects comprises: providing a mold comprising at least two complementary parts which define at least three molding cavities interconnected by runner channels, a first of said cavities configured to form a point cutting assembly comprising a pencil guide and adapted to hold a cutting blade, a second of the cavities configured to form a first adaptor sleeve having an inside diameter smaller than that of the pencil guide and an outside configuration operative to releasably engage the inner wall of the pencil guide, and a third of the cavities configured to form a second adaptor sleeve having an inside diameter smaller than that of the first sleeve and an outside configuration operative to releasably engage the inner wall of the first sleeve; filling the mold cavities and runner channels with a fluid, hardenable plastic material; hardening the plastic material; opening the mold; and removing the pencil guide and the first and second adaptor sleeves, interconnected by runners. These runners, by proper design, can be utilized as adaptor holding means for holding the sleeves when not in use.

BRIEF DESCRIPTION OF THE DRAWING

The invention will be better understood and its advantages will become more apparent from the following detailed description, especially when read in light of the attached drawing, wherein.

BEST MODE FOR CARRYING OUT THE INVENTION

Figures 1, 2, 3, 4, 5:
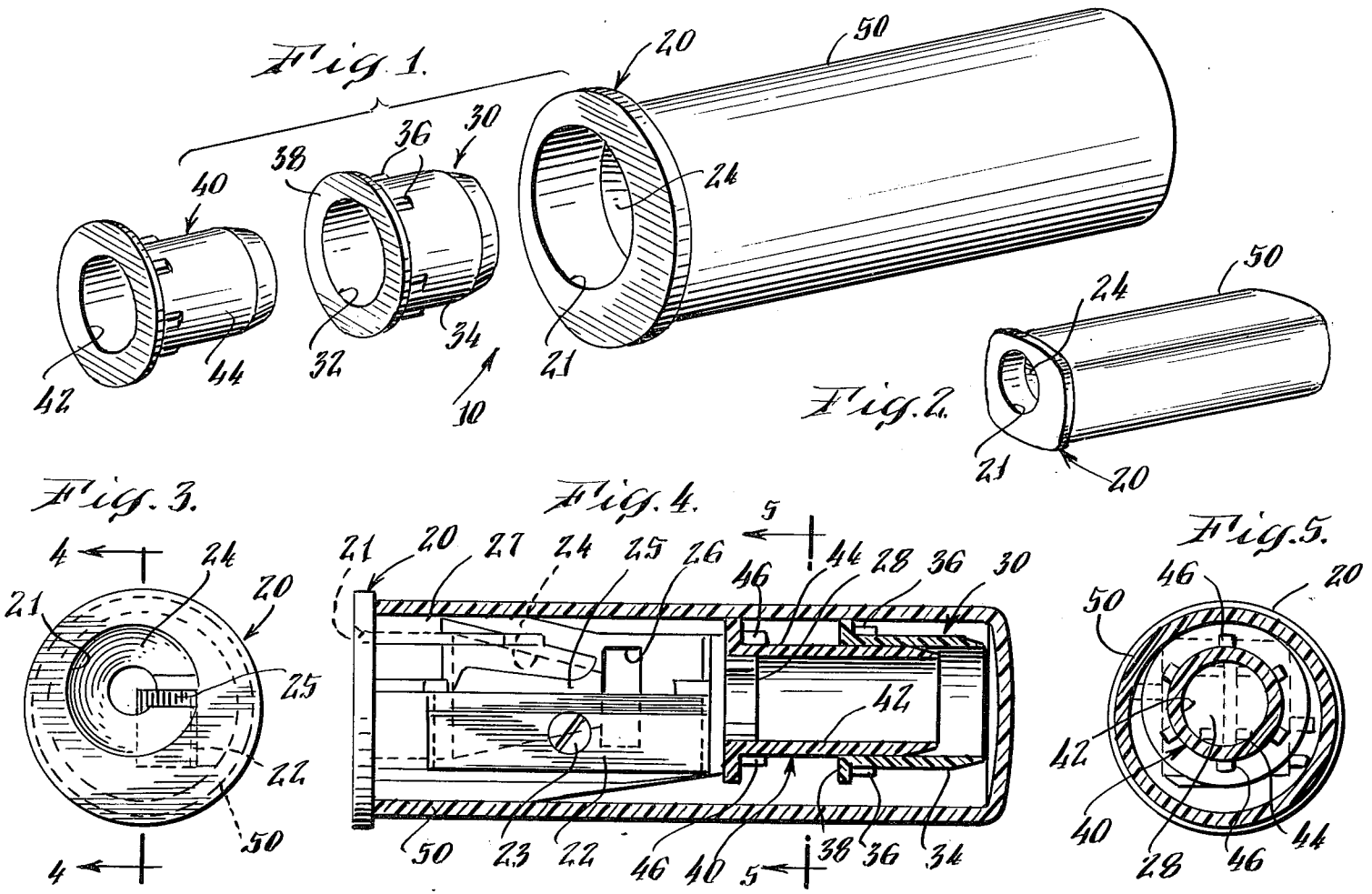
FIG. 1 is a partially-exploded perspective view of one embodiment of the invention.
FIG. 2 is a perspective view of a sharpener according to the invention having a single adaptor sleeve and a non-circular cross section.
FIG. 3 is a front elevation of the device shown in FIG. 1.
FIG. 4 is a cross-sectional view taken along the longitudinal axis of the sharpener in the direction indicated by line 4—4 in FIG. 3.
FIG. 5 is a cross-sectional view taken perpendicular to the longitudinal axis of the sharpener along line 5—5 in FIG. 4.

Referring now to FIG. 1, the outer appearance of a pencil sharpener according to the present invention is shown generally as 10. While the pencil sharpener shown in FIG. 1 is cylindrical, it may have other shapes, such as square or triangular in cross section. One such configuration is shown in FIG. 2. The pencil sharpener is shown to comprise a point cutting assembly shown generally as 20, a first cylindrical adaptor sleeve shown generally as 30, and a second cylindrical adaptor sleeve shown generally as 40. Shown also in FIG. 1 is cuttings holder means 50 positioned around the point cutting assembly 20. The point cutting assembly 20 has a cylindrical pencil guide 21 which is adapted to fit pencils having approximately the same diameter as the guide. First sleeve 30 has an interior wall 32 with a smaller diameter than that of guide 21 and has its exterior configuration operative to releasably engage the inner surface of the guide 21. The second cylindrical adaptor sleeve 40 has an inside surface 42 with a diameter smaller than that of the first adaptor sleeve 30 and an outside configuration 44 operative to releasably engage the inner surface 32 of the first adaptor sleeve 30.

It is an advantage of the present invention that one, two or even more than two adaptor sleeves can be provided. The additional sleeves will be configured similarly to two sleeves 30 and 40, but have increasingly smaller interior diameters. Another advantage of the invention is that these sleeves, despite the number, can be neatly nested one within the other to permit sharpening of pencils having different diameters without affecting the overall outer appearance of the pencil sharpener. When the adaptor sleeves are not in use, they are neatly stored by virtue of an adaptor holding means which can comprise a cuttings holder means 50 which can enclose the adaptor sleeves as shown in FIG. 3, as will be described in greater detail later.

As can be seen from FIGS. 1 and 3 through 5, the cylindrical pencil guide 21 has its central axis positioned eccentrically of the central axis of the pencil sharpener which is concentric with the axis of the tubular cuttings holder means 50 in this embodiment. While cuttings holder means 50 is shown here as a cylindrical tube having one closed end and one open end, it can be of any cross-sectional shape, regular or irregular so long as it can be telescoped over the point cutting assembly 20 and any adaptor sleeves not in use. It is an advantage of the present invention that the cuttings holder means 50 not only collects cuttings, but also covers unused adaptor sleeves and presents an elegantly clean and simple exterior appearance. Thus, the rounded square shape shown in FIG. 2 functions in the same manner as that in FIG. 1, but has the added advantage that it will not permit easy rolling off of a horizontal surface.

Referring now to the cross-sectional view of FIG. 4, the point cutting assembly 20 is shown to have cutting blade 22 secured by screw 23 along one portion of the frusto conical section 24 of the point cutting assembly 20. Open areas 25 and 26 enable cuttings resulting from sharpening to exit the area of the cutting blade 21 to be held by the cuttings holder means 50. Ribs 27 are located around the point cutting assembly 20 to position the assembly within the cuttings holder means 50.

Positioned at the end of the point cutting assembly 20 opposite the cylindrical pencil guide 21 is one form of adaptor holding means, shown as a projection 28 for holding the second sleeve 40 when it is not in use. In the case where only a single adaptor sleeve is provided, the projection 28 will hold the single adaptor. The projection 28 can be of any geometrical configuration so long as it provides sufficient points of contact with the interior surface 42 of the second sleeve 40 to permit a good fit in a telescoping relationship as shown in FIGS. 4 and 5. If desired, the projection can comprise runners formed during the molding process. When the first sleeve 30 is also not in use, it telescopes over the exterior 44 of the second sleeve 40. Lugs 46 on the second sleeve and 36 on the first sleeve provide spacing and a degree of strength. Thus, when first sleeve 30 is inserted within the cylindrical pencil guide 21, inward telescoping movement is restricted by lugs 36 so that removal with the fingertips remains simple and the trouble of prying off the first sleeve with the fingernails is avoided. Similarly, when second sleeve 40 is telescoped within first sleeve 30 in operative position, the lugs 46 prevent excessive inward telescoping movement of the second sleeve within the first.

In operation, a pencil of desired diameter is matched with the pencil guide 21, the first sleeve interior surface 32 or the second sleeve interior surface 42, and the appropriate sleeve or sleeves are placed in operative position. Where the sleeves are not required, they may be held by the adaptor holder means which can comprise projection 28. When the sleeves are placed in the appropriate operative or inoperative positions, the cuttings holder means 50 is telescoped over the point cutting assembly 20 and maintained in proper position by ribs 27. The pencil is then simply inserted and turned within the point cutting assembly in conventional fashion and the cuttings are held within the cuttings holder means 50 until a time when it becomes convenient to empty the contents. If desired, the projection 28 can be omitted, with the cuttings holder means 50 providing the added function as the adaptor holding means.

The pencil sharpener is preferably made of a thermoplastic material such as crystalline polypropylene which has the advantages that it is not only light in weight, but it is also somewhat resilient and has a desirable strength to weight ratio. This has a number of advantages including its ability to form snugly nestable parts. However, other thermoplastic materials such as polystyrene, and even thermosetting materials can be employed. It is important to the method of the present invention that the plastic material be moldable in that it be capable of flowing into a mold cavity in liquid condition and then hardened therein prior to removal.

One particular advantage of the method of the invention is that the point cutting assembly and first and second adaptor sleeves can be molded in a single operation and are interconnected upon removal from the mold. This is accomplished by providing a mold having at least two complementary parts which when closed define at least three molding cavities for molding the point cutting assembly and the two sleeves interconnected by runner channels. In their open positions, the complementary parts of the mold permit stripping of the molded parts from the recesses within the mold. To better facilitate stripping, enlarged areas such as flanges 38 and 48 of the first and second adaptor sleeves 30 and 40 respectively, are preferably positioned at the parting line of the two mold sections in one of the mold sections, and cylindridal portions defining outer surfaces 34 and 44 respectively, are formed by recesses in a complementary mold section. Runner channels positioned at the mold parting line will interconnect the various mold cavities and the inlet for the molding material. By proper design, one or more runners can be formed for use as the projection 28.

In performance of the method, the complementary mold parts are closed to form the cavities and the cavities are then filled with a fluid, hardenable plastic material. The plastic material is then hardened: by cooling in the case of a thermoplastic material, or heating in the case of a thermosetting material. The mold is then opened and the molded parts, interconnected by at least one runner of molded plastic, are then removed. It is an advantage of the present invention that a complete set of parts except for the sleeve can be formed in a single operation and maintained together awaiting final assembly. If desired, however, the various parts can be molded in separate procedures according to techniques known to the art. The cutting blade 22 is attached to the point cutting assembly by means of screw 23 or other means which may be simply a deformable, integrally-molded rivet.

The cuttings holder means 50 can be similar in construction to the outer cap of a conventional lipstick tube or can be constructed of a plastic material in the same operation in which the other parts are molded.

The above description has been for the purpose of teaching the person skilled in the art how to make and use the present invention. This description is not intended to set forth in detail each and every obvious modification and variation of the invention. However, it is intended that all such modifications and variations be included within the scope of the present invention which is defined by the following claims.

We claim:

1. A cosmetic pencil sharpener adapted to sharpen pencils of a plurality of sizes, comprising:

a point cutting assembly comprising cutting means and a pencil guide adapted to axially position a pencil for cutting by said cutting means;

an adaptor sleeve having an inner cylindrical surface with a diameter smaller than that of said pencil guide and at one end having an outside configuration releasably engaging the inner surface of said guide, and at the other end having a flange and means adjacent to said flange for spacing said flange from said point cutting assembly to permit easy grasping and removal of said sleeve from said guide; and a cuttings holder means for catching and holding cuttings produced by sharpening a pencil, said cuttings holder means comprising a tube having a generally square cross section with gently rounded corners and sides and further having one closed end and one open end, said open end being configured to releasably hold said point cutting assembly such that the longitudinal axis of said tube is parallel with but eccentric to the longitudinal axis of said guide.

2. A pencil sharpener according to claim 1 which further comprises adaptor holding means comprising means projecting from the end of said cutting assembly which is opposite to said pencil guide, said means operable to releasably engage the inner cylindrical surface of said sleeve and to position said sleeve along an axis parallel to the longitudinal axis of said pencil guide such that said sleeve is covered by said cuttings holder means.

3. A pencil sharpener adapted to sharpen pencils of a plurality of sizes comprising:

a point cutting assembly comprising cutting means, at one end an opening to a cylindrical pencil guide adapted to axially position a pencil for cutting by said cutting means, and at the end opposite said opening, an adaptor holding means comprising a projection therefrom;

a first cylindrical adaptor sleeve having an inside diameter smaller than that of said pencil guide and an outside configuration releasably engaging the inner surface of said guide; and a second cylindrical adaptor sleeve having an inside diameter smaller than that of said first adaptor sleeve and an outside configuration releasably engaging the inner surface of said first adaptor sleeve; wherein said adaptor holding means is configured to telescopically hold said second adaptor sleeve when not positioned within said pencil guide and said first sleeve is configured to telescope over said second sleeve.

4. A pencil sharpener according to claim 3 wherein both of said adaptor sleeves comprise a flange at one end thereof.

5. A pencil sharpener according to claim 4 wherein each of said adapter sleeves further includes spacer ribs extending rearwardly of said flanges.

* * * * *